US006755007B1

(12) United States Patent
Becker

(10) Patent No.: US 6,755,007 B1
(45) Date of Patent: Jun. 29, 2004

(54) DEVICE FOR PRODUCING ELECTRICAL CONTACT PARTS

(75) Inventor: Wolfgang Becker, Marienheide (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 8 days.

(21) Appl. No.: 10/312,250

(22) PCT Filed: Jul. 3, 2000

(86) PCT No.: PCT/EP00/06196

§ 371 (c)(1),
(2), (4) Date: Dec. 23, 2002

(87) PCT Pub. No.: WO02/05390

PCT Pub. Date: Jan. 17, 2002

(51) Int. Cl.[7] ..... B05B 61/02

(52) U.S. Cl. ..... 53/411; 53/415; 53/131.2; 53/135.1; 53/136.1; 53/118

(58) Field of Search ..... 53/415, 411, 131.2, 53/135.1, 136.1, 136.2, 118; 29/729

(56) References Cited

U.S. PATENT DOCUMENTS 4,527,857 A * 7/1985 Hughes et al. ..... 439/849
4,648,184 A 3/1987 Schuir et al.
5,427,549 A * 6/1995 Smith et al. ..... 439/701
5,775,215 A * 7/1998 Hirate ..... 101/4
5,796,065 A 8/1998 Fujiyoshi et al.
5,863,223 A * 1/1999 Arnold ..... 439/701
5,941,736 A * 8/1999 Murakami ..... 439/733.1

* cited by examiner

*Primary Examiner*—Stephen F. Gerrity
*Assistant Examiner*—Hemant Desai
(74) *Attorney, Agent, or Firm*—Brooks Kushman P.C.

(57) ABSTRACT

A device for producing individual metal contact parts for electrical connectors includes a processing machine for processing a semi-finished product to assemble the electrical contact parts as one unit on a strip. The device includes a packaging device connected downstream of the processing machine in the direction of travel of the strip. The packaging device includes an exchangeable storage and transport module such as a spool for receiving a given length of the strip formed by the individual, assembled contact parts. A marking device is mounted between the processing machine and the packaging device. The marking device places an identification on each of the individual contact parts on a length of a strip assigned to the spool. The identification characterizes the strip segment and is different from the identification of other strip segments on other spools. The marking device marks the individual contact parts in the form on an impression.

9 Claims, 1 Drawing Sheet

DEVICE FOR PRODUCING ELECTRICAL CONTACT PARTS

BACKGROUND OF THE INVENTION

1. Field of the Invention

The invention concerns a device for producing individual metal electrical contact parts that are joined together as a unit in a band for electrical plug-in connectors with a processing machine for single-stage or multiple-stage processing of a semi-finished product to produce the electrical contact parts and with a packaging device that is downstream of the processing machine in the direction that the band travels and that has an exchangeable storage and transport module to hold a certain length of the bandware consisting of the individual contact parts that are joined together. The invention also concerns a spool that has bandware wound around it which consists of a number of individual metal electrical contact parts that are put together as a unit in a band for electrical plug-in connectors as well as an individual electrical contact part for an electrical plug-in connector, each made with such a device.

2. Background Art

Metal electrical contact parts for use in electrical plug-in connectors, for example to equip a cable tree for a motor vehicle, are made as bandware. A known device for producing such a band or band section consisting of a number of individual electrical contact parts, which joined together represent the bandware, includes a processing machine into which is fed, on the input side, a sheet metal strip that is unwound from a coil or reel. In the processing machine, the individual contact parts are produced at a specified tempo in several steps, by punching, bending, and/or welding processes, and are still connected together at the exit of the processing machine. Downstream of the processing machine, in the direction in which the band travels, is a packaging device with an exchangeable storage and transport module. The storage and transport module can be, for example, a spool, which has a certain length of bandware wound on it. Here, to prevent interlocking of electrical contact parts in adjacent layers, they can be separated from one another by an intermediate layer that is also fed when the spool is wound.

After such a spool is wound with the intended band length, it can be separated from the packaging device and put into a warehouse. Beforehand, the spool is normally given an identification, giving the type and/or the size of the individual contact parts located on the spool, for example.

When the sheet metal strips are processed in the processing machine to produce the individual contact parts, the individual contact parts are also identified with a manufacturer's identification, as a rule using a stamping process.

The processing speed of the processing machine that is used to produce such electrical contact parts is so high that the packaging device normally has several spools arranged next to one another, so that when one spool is wound, the next one can be wound as soon as the wound spool is replaced by an empty one. However, one of the consequences of the high processing speed and the correspondingly fast winding of an individual spool is that there are mix-ups when the individual spools are manually labeled. This is especially undesirable if such identification also contains a batch number, since then the contact part that is produced is assigned to the wrong batch.

Traceability of the electrical contact parts used in the cable tree of a motor vehicle, for example, is increasingly desired, even if the electrical contact parts are produced in this way.

In the end such a contact part can be traced back to the manufacturer through such stamped-in company identification. However, this identification cannot provide information that could establish within what batch or within what processing interval such an electrical contact part was produced. Such information is also desirable especially for reasons having to do with product liability, since it would also be desirable for the manufacturer of such electrical contact parts to establish who received the section of band with such an electrical contact part, since an error coming from such a contact part can lie not only in the manufacture of the electrical contact part, but also in its further processing by the buyer of the spool.

In theory it would be possible for a batch number also to be stamped into such an electrical contact part along with the company logo. However, this has the disadvantage that every time the spool is changed, the stamping die in the processing machine would also have to be changed. Changing the stamping die in the processing machine normally takes several hours, so that spool-by-spool identification in this way is not economical. Moreover, it would also prove to be difficult to be able to stamp very small contact parts with the necessary resolution.

SUMMARY OF THE INVENTION

Therefore, starting from the prior art which has been discussed, the invention is based on the task of further developing a device of the type mentioned at the beginning in such a way that it can be used to identify the individual electrical contact parts in the form that is desired, without affecting processing speed.

This task is solved according to the invention by the fact that along the direction in which the band travels, between the exit from the processing machine and the downstream packaging device, there is a labeling device for identifying each individual contact part which belongs to a length of band assigned to a storage and transport module with an identification that identifies this band section and differs from the identification of other band sections on other storage and transport modules, with the labeling device being designed to identify the individual contact parts using a type of stamping.

To identify the individual electrical contact parts of a certain section of band, a labeling device is arranged downstream of the processing machine and upstream from the packaging machine, in the direction in which the band travels. This labeling device is designed to provide each individual contact part with an identification, with it being possible for all contact parts within a section of band to have the same identification or also a different identification. This identification of each contact part differs from that of other band sections.

To ensure that the labeling put on by the labeling device remains identifiable during further processing steps, the labeling device is designed to identify the individual contact parts using a type of stamping, for example by a burning in or a burning off process. It is expedient to use a labeling laser as the labeling device, since such a labeling device not only can ablate material to put on the identification, but also since such a labeling device can also put the identification onto each individual contact part with a high speed. Thus, such a device makes it possible for individual electrical contact parts which are produced as bandware and which are separated into individual parts at a later point in time in their use, to be identified in such a manner that even an individual electrical contact part can be identified, and this is done without affecting the processing speed when these parts are produced.

However, it is always considered sufficient for all the contact parts located on a storage and transport module, for example a spool, to bear the same identification. The manufacturer archives this identification in an appropriate way so that even at a later point in time it can be established from what batch and under what manufacturing conditions such a contact part was produced.

In order to realize an unambiguous assignment between the contact parts located on a spool and an identification of the spool itself which cannot be mixed up, a further development provides that the packaging device has a device to feed an intermediate layer when the band section is wound up onto the spool, and that this device for feeding the intermediate layer includes a labeling device for identifying the intermediate layer with the same information with which the individual contact parts of the band section wound on this spool are identified. The intermediate layer also covers the outer layer of the bandware and the identification of the intermediate layer is at least also put on the outside of this section of the intermediate layer. Compulsory feeding of the identified intermediate layer identifies the spool in a band material-dependent way. Therefore, this avoids erroneous identification of the ware located on a spool, since there is no manual intervention. Especially when reusable spools are used, it can be established, without the danger of a mix-up, which contact parts on which spool were delivered to which buyer.

BRIEF DESCRIPTION OF THE DRAWINGS

The invention is described below using a sample embodiment that refers to the attached figures. The figures are as follows.

DETAILED DESCRIPTION OF THE PREFERRED EMBODIMENT(S)

Figure 1:
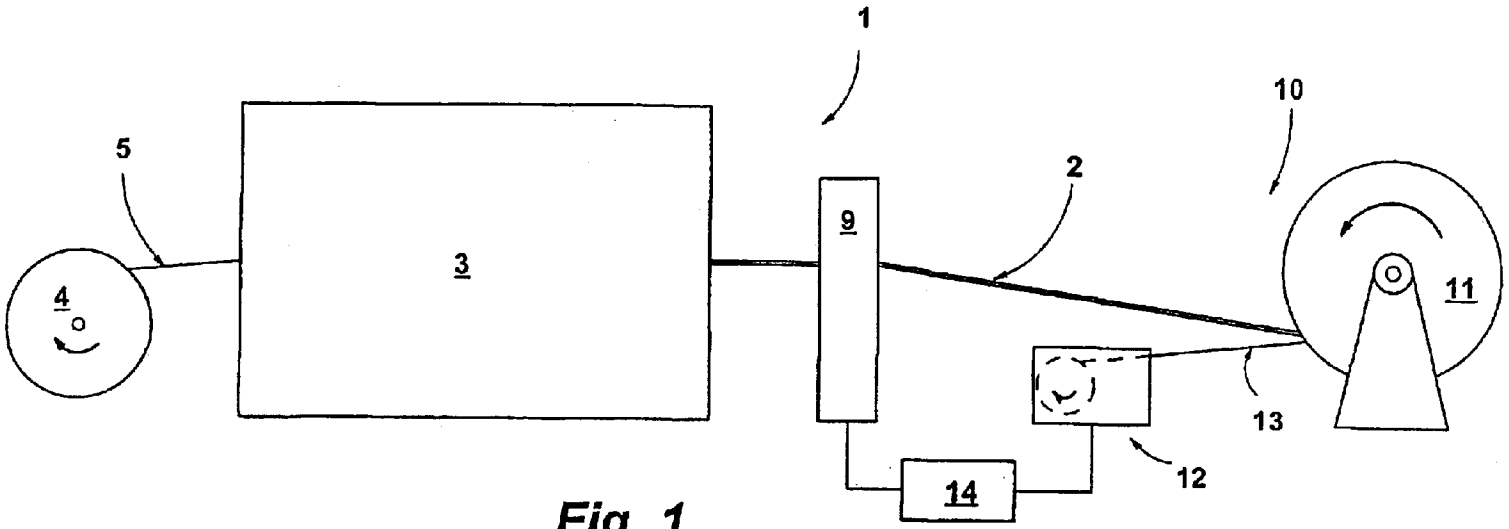
FIG. 1: A schematic illustration of a device for producing metal contact parts that are joined together as a unit in a band.

A device 1 for producing individual metal electrical contact parts that are joined together as a unit in a band 2 includes a processing machine 3, into which is fed, on the input side, a sheet metal strip 5 that is wound as a semi-finished product on a coil 4. Processing machine 3 is designed to perform punching, bending, and/or welding operations on the sheet metal strip 5 to produce, at a specified tempo, individual metal electrical contact parts K that are joined together in a band 2.

Figure 3:
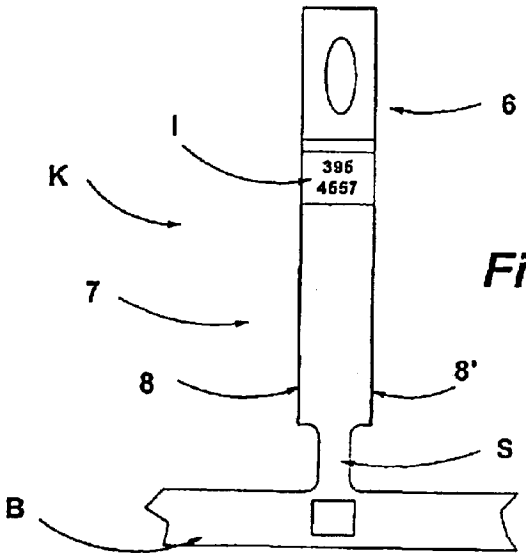
FIG. 3: An enlarged top view of a contact part of the band section shown in FIG. 2.
Figure 2:
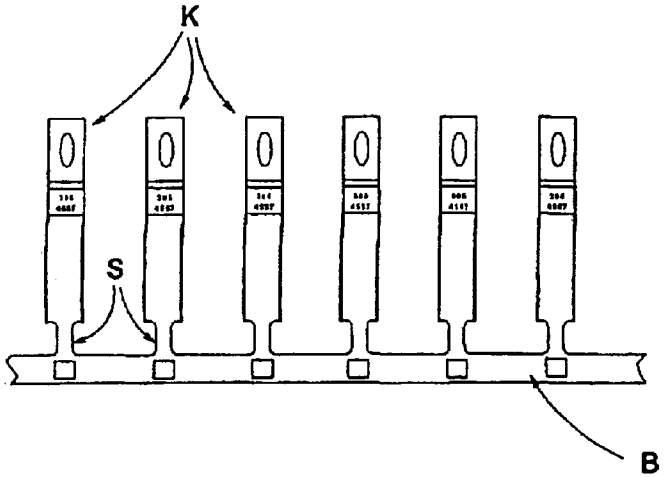
FIG. 2: A top view of a band section with several electrical contact parts produced by the device shown in FIG. 1.

FIG. 2 shows such electrical contact parts in a segment of band 2, and they are identified in it with the reference letter K. These contact parts have a front housing section 6 into which a contact blade is inserted. Thus, an electrical contact part K is made in the form of a socket part. The back area of such a contact part K includes, as shown in FIG. 3, a crimping section 7, whose cross section is U-shaped and whose two side parts 8, 8' are arranged to project upwards. Crimping section 7 allows the insertion of an electrical conductor which can be held squeezed in section 7 by folding together side parts 8, 8'. Each individual contact part K is connected through a connecting tab S to a band B connecting the individual contact parts K with one another. Before individual contact parts K are used they are separated from band B.

Processing machine 3 has, downstream of it in the direction in which the band travels, a labeling laser 9, through which is fed band 2 consisting of Band B and the contact parts K fastened to it. This labeling laser identifies the individual contact parts K with an identification number I. Labeling laser 9 is able to put the desired identification into the surface of the individual contact parts K at such a speed that the labeling process does not require slowing the tempo at which processing machine 3 operates. Labeling laser 9 has, downstream of it, a packaging device 10, which essentially includes a spool 11, onto which band 2 is wound. Packaging device 10 also has assigned to it a device 12 to feed an intermediate layer 13 of paper onto spool 11 when band 2 is wound onto it. Intermediate layer 13 prevents the interlocking of individual contact parts K in adjacent layers. Device 12 to feed intermediate layer 13 also includes a printer which prints an identification on the outside of intermediate layer 13. Labeling laser 9 and device 12 for feeding an intermediate layer 13 are connected to a common control device 14, perhaps a production control console.

The sample embodiment shown in the FIGS. provides that all contact parts K which belong to a band section that is on a spool 11 receive the same identification. In this sample embodiment, intermediate layer 13 also receives the same information, which can be printed on as a number or a barcode, for example, to identify spool 11. When spool 11 is wound, intermediate layer 13 is fed until the outside, and thus the peripheral surface of wound band 2, is also covered by intermediate layer 13, so that it not only provides transportation protection for contact parts K but rather also has the special advantage of making it possible to read, using a reading device, for example, the identification of the ware on spool 11, which is on the peripheral surface of this spool. Such an embodiment is advantageous above all when spool 11 is a reusable spool, so that then no mix-ups or wrong assignments of earlier identifications are possible regarding the name of the ware located on spool 11.

The identification I of the individual contact parts K in this sample embodiment is provided by a sequence of numbers. Accordingly, the individual contact parts of the following band sections which are to be wound on other spools receive a different identification. Since the identification of the individual contact parts K can also be read on the outside of intermediate layer 13, this identification can be assigned to a delivery of wound spool 11 to a buyer, so that later it is possible to make a direct assignment between a contact part K and the buyer who received spool 11 with this batch.

The device according to the invention is suitable not only for producing such electrical contact parts as are shown in the FIGS., but rather also electrical contact parts of any type, if they are joined together as a unit and therefore can also be packaged in continuous bands.

| List of Reference Numbers | |
|---|---|
| 1 | Device |
| 2 | Band |
| 3 | Processing machine |
| 4 | Coil |
| 5 | Sheet metal strip |
| 6 | Housing section |
| 7 | Crimp section |
| 8, 8' | Side part |
| 9 | Labeling laser |
| 10 | Packaging device |

-continued

| List of Reference Numbers | |
|---|---|
| 11 | Spool |
| 12 | Device |
| 13 | Intermediate layer |
| B | Band |
| I | Identification |
| K | Electrical contact part |
| S | Connecting tab |

What is claimed is:

1. A system for producing individual metal electrical contact parts for electrical plug-in connectors, the system comprising:

a processing machine for single-stage or multiple-stage processing of a semi-finished product to produce individual metal electrical contact parts which are joined together as a unit in a band;

a packaging device positioned downstream of the processing machine for receiving the band of individual contact parts from the processing machine, the packaging device having an exchangeable storage and transport module operable for holding a certain length of the band; and a labeling device positioned between the processing machine and the packaging machine, the labeling device being operable for identifying each individual contact part which belongs to a length of the band assigned to the storage and transport module with an identification that identifies this band section and differs from the identification of other band sections on other storage and transport modules, wherein the labeling device identifies the individual contact parts with a type of stamping.

2. The system of claim 1 wherein:

the storage and transport module is a spool.

3. The system of claim 2 wherein:

the packaging device comprises a device to feed an intermediate layer when the band section is wound onto the spool, and that this device has a labeling device assigned to it for putting on the intermediate layer identification containing the same information which identifies the individual contact parts of the band section wound on the spool.

4. The system of claim 3 wherein:

the intermediate layer made of paper and the labeling device is a printer.

5. The system of claim 3 wherein:

the labeling device for identifying the individual contact parts and the labeling device for identifying the intermediate layer arc connected to a common control device.

6. The system of claim 3 wherein:

each individual contact part bears identification in the form of a type of stamping, and that the individual band layers formed by the winding of the spool have arranged between them an intermediate layer which has identification reproducing the information identifying the individual contact parts and which also covers the outer band layer and whose identification is arranged at least on the outside of the section covering the outer band layer.

7. The system of claim 1 wherein:

the labeling device is a labeling laser.

8. The system of claim 1 wherein:

each individual contact part bears an identification in the form of a type of stamping from which its manufacture time can be derived.

9. The system of claim 8 wherein:

each individual contact part includes a crimping section for connecting an electrical conductor, wherein the identification is located at the top of the section of the individual contact part that is on the plug side of the crimping section.

* * * * *